US006142159A

United States Patent [19]

Lloyd

[11] Patent Number: 6,142,159

[45] Date of Patent: Nov. 7, 2000

[54] HAIR CLASP

[76] Inventor: Lisa Lloyd, 3335 N. Manor Dr., Tucson, Ariz. 85750

[21] Appl. No.: 09/224,595

[22] Filed: Dec. 31, 1998

[51] Int. Cl.[7] ..... A45D 8/22; A45D 8/04; A45D 8/00

[52] U.S. Cl. ..... 132/278; 132/279; 132/273; 132/276; 132/277

[58] Field of Search ..... 132/273, 275, 132/276, 277, 278, 280, 281, 828, 283, 284

[56] References Cited

U.S. PATENT DOCUMENTS

| | | | |
|---|---|---|---|
| 1,155,399 | 10/1915 | Bechtold | 132/273 |
| 2,998,015 | 8/1961 | Gresham et al. | 132/273 |
| 5,115,825 | 5/1992 | Kuhn | 132/273 |
| 5,458,109 | 10/1995 | Tu | 132/279 |
| 5,477,870 | 12/1995 | Menaged | 132/279 |
| 5,495,862 | 3/1996 | Dewing | 132/279 |
| 5,520,201 | 5/1996 | Hart et al. | 132/277 |
| 5,590,668 | 1/1997 | Macy | 132/200 |
| 5,816,267 | 10/1998 | Chou | 132/145 |

*Primary Examiner*—John J. Wilson
*Assistant Examiner*—Rubyn K. Doan
*Attorney, Agent, or Firm*—Ellis, Venable, Busam & Wittenberg, LLP

[57] ABSTRACT

A barrette made of a single flat strip of PETG that is formed into a shape that will encircle and bind a braid of hair. The shape is formed such that the two ends of the flat strip join when in a closed position. The ends of the flat strip have teeth such that the two ends of the flat strip mate when the barrette is in a closed position. The interior of the barrette is provided with a row of teeth in order to grip the hair and prevent it from slipping through the barrette.

7 Claims, 3 Drawing Sheets

FIG. 4
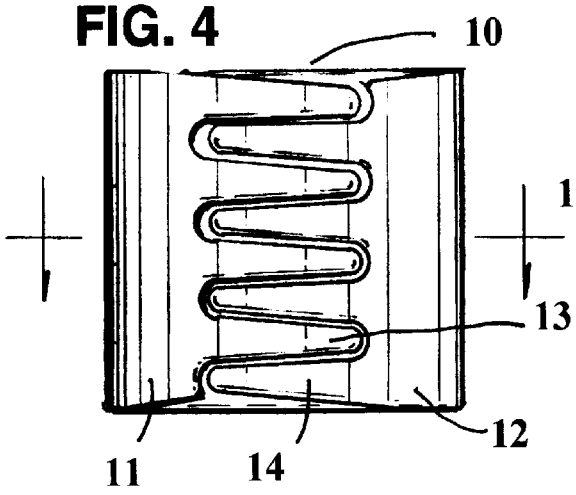
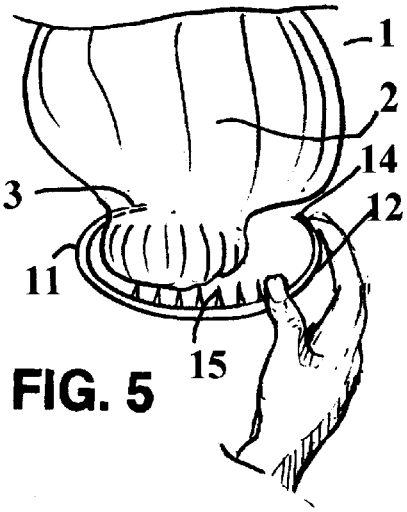
FIG. 5
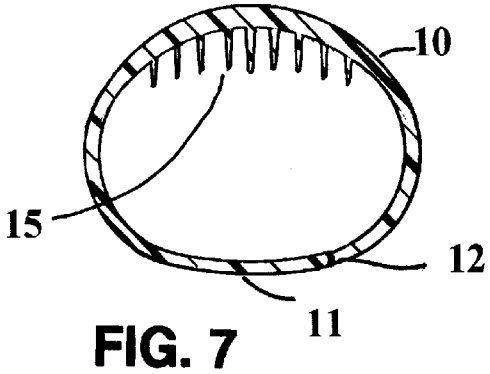
FIG. 7
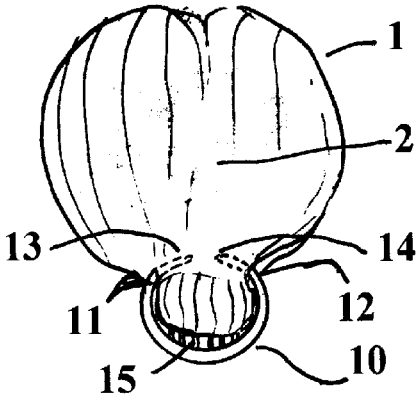
FIG. 6
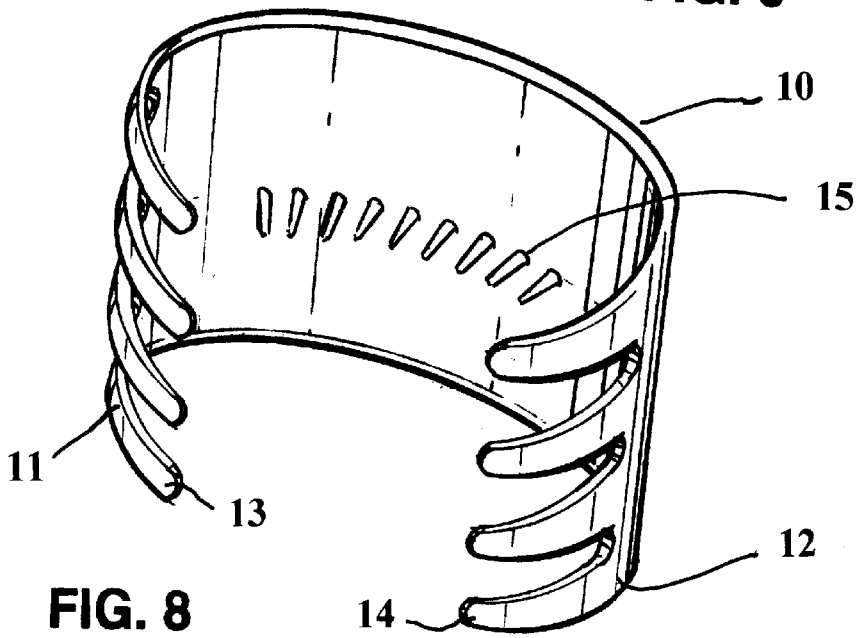
FIG. 8

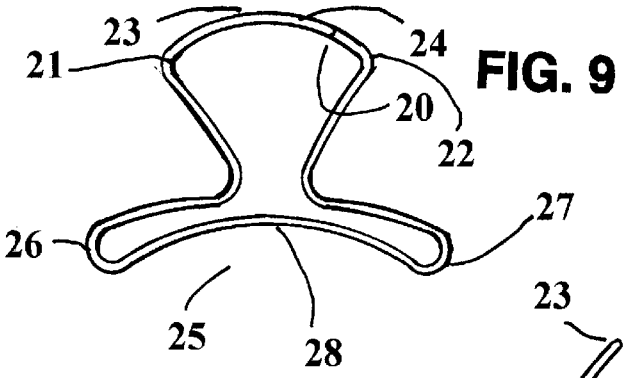
FIG. 9
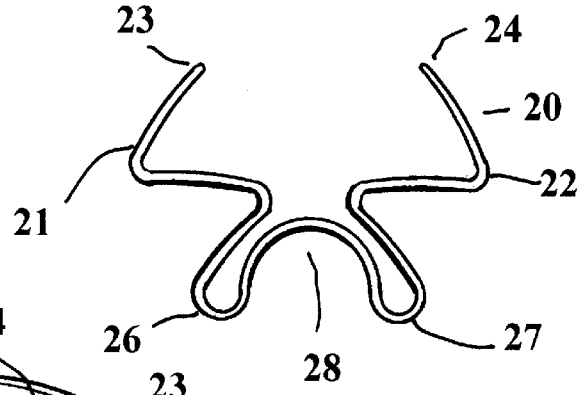
FIG. 10
FIG. 11
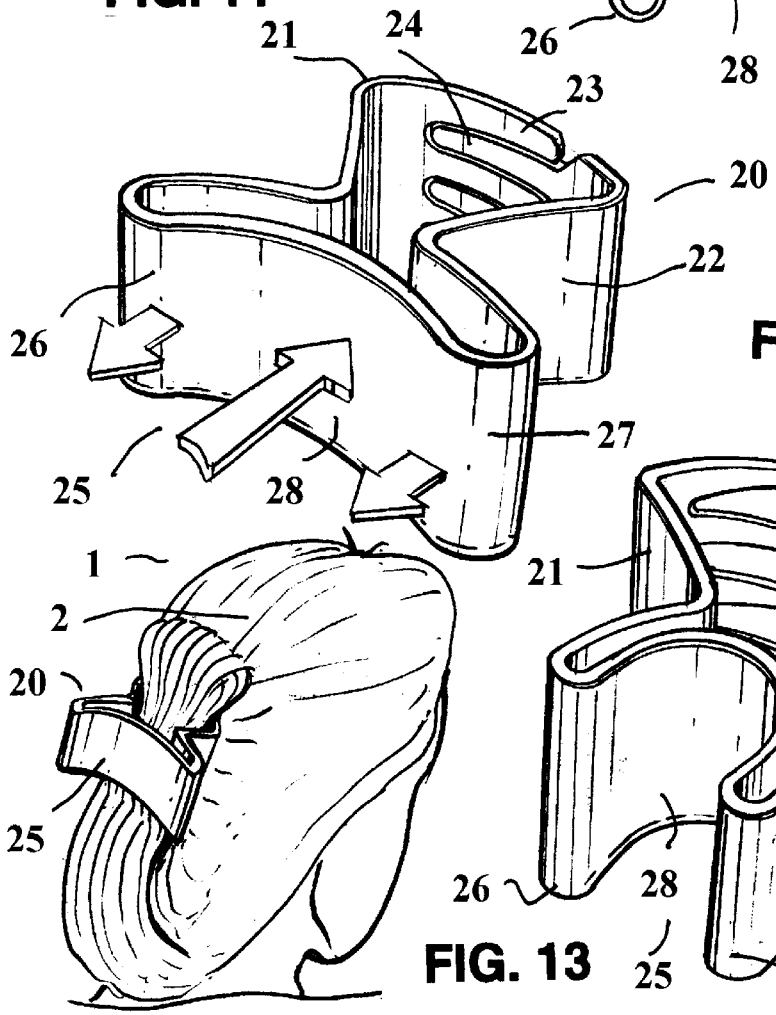
FIG. 12
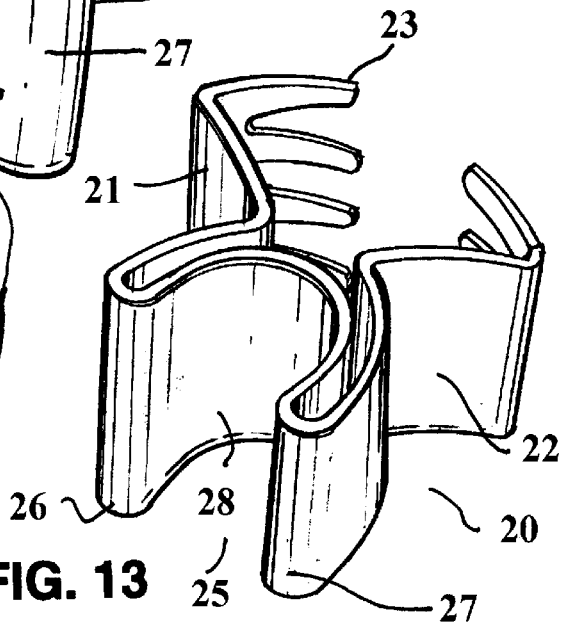
FIG. 13

HAIR CLASP

FIELD OF THE INVENTION

The present invention relates to the field of devices for shaping human hair and more particularly to mechanical clasps which bind human hair in a styled position.

BACKGROUND

People are constantly searching for new ways to improve the visual appearance of the human body. Hair receives a great deal of attention in humanity's quest for beauty. Throughout the ages, individuals have used different types of mechanical devices to help shape and style their hair. Modern day inventors have recognized this demand for hair styling products and have responded by developing numerous types of barrettes.

Barrettes are well known and exist in many varieties. The present state of the art generally teaches toward barrettes that are made of two arms that are hinged together. These two arms typically have a row of teeth which operate as a hair gripping mechanism. The two arms are held together in a fixed position by a clasp. To place this barrette in a person's hair, the clasp is undone and the arms are opened. The hair is placed between the two arms in the teeth. The clasp is then closed to secure the arms.

A double sided barrette having a pair of support members is disclosed in Menaged, U.S. Pat. No. 5,477,870. This patent teaches that the pair of support members are coupled to each other by a hinge such that the support members can pivot between open and closed positions. When in a closed position, a clasp operably engages these support members and maintains them in a releasably fixed position.

A barrette that has multiple hinged members is disclosed in Chou, U.S. Pat. No. 5,816,267. This patent teaches the use of a comb integrated with one of the hinged members to improve the device's ability to grip and hold human hair.

One flaw with hinged barrettes is that human hair may become caught in the hinge causing discomfort to the wearer. It is also important to note that producing barrettes that have multiple components which have to be assembled increases the manufacturing cost. The present invention solves these problems through providing a novel barrette that is comprised of a single unit.

SUMMARY OF THE INVENTION

In accordance with the invention claimed, a novel barrette is disclosed that is made of a single piece of injection molded plastic thereby reducing manufacturing costs. The present invention is a single continuous strip of plastic that has two ends provided with teeth. The strip of plastic is formed into a shape where the two ends of the strip come together such that the teeth on each end mate and a braid of hair is secured in the center of the barrette. A person can place a braid of hair into this single piece barrette by pulling the two mated ends apart. The braid of hair is then inserted through the open barrette while the ends are held apart in tension. Through releasing the ends of the barrette held apart in tension, the device returns to its original closed position thereby gripping the braid of hair.

The key to this invention is the type material. The critical design parameter is that a user will only cause elastic deformation in the device when pulling the ends apart to insert a braid of hair. By only causing elastic deformation in the device, the device will return to its original shape when the user releases the ends. PETG is one preferred material that has desirable tensile properties that is used for the present invention.

In one preferred embodiment, the plastic strip is formed into a substantially circular shape. To place a braid of human hair into this generally circular plastic strip, a person would pull the two ends of the strip apart. In this embodiment, a row of teeth is provided on the interior of the device to further grip the hair. In another embodiment, the plastic is formed such that an operable handle is formed. When compressed, the handle pulls the mated ends apart thereby enabling hair to be inserted into the device.

It is the primary object of the invention to provide a new barrette that is comprised of a single component.

An additional object of the invention is to provide a barrette that will not tangle or snare human hair in its structure.

A further object of the invention is to provide a barrette that has a manufacturing cost lower than barrettes currently competing in the marketplace.

A still further object of the invention is to provide a barrette that binds hair through having the hair place the barrette in a state of tension.

Further objects and advantages of the invention will become apparent as the following description proceeds and the features of novelty which characterize this invention are pointed out with particularity in the claims annexed to and forming a part of this specification.

BRIEF DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings wherein:

FIG. 4 is a front view of the generally circular barrette showing the two ends mated together in a closed position FIG. 5 is a top view showing the generally circular barrette in an open position with the ends separated as it is being placed on the hair of a woman;

FIG. 6 is a top view of the generally circular barrette in a closed position;

FIG. 7 is a cross sectional view of the generally circular barrette;

FIG. 8 is a perspective view of the generally circular barrette in an open position with the two ends pulled apart;

FIG. 9 is a top view of the barrette with a handle in a closed position;

FIG. 10 is a top view of the barrette with a handle in an open position;

FIG. 11 is a perspective view of the barrette with a handle showing the acting forces on the handle which place the barrette in an open position;

FIG. 12 is a perspective view of the barrette with a handle in an open position; and FIG. 13 is a perspective view of the barrette with a handle in a closed position on the head of a woman.

DESCRIPTION OF PREFERRED EMBODIMENTS

Figure 1:
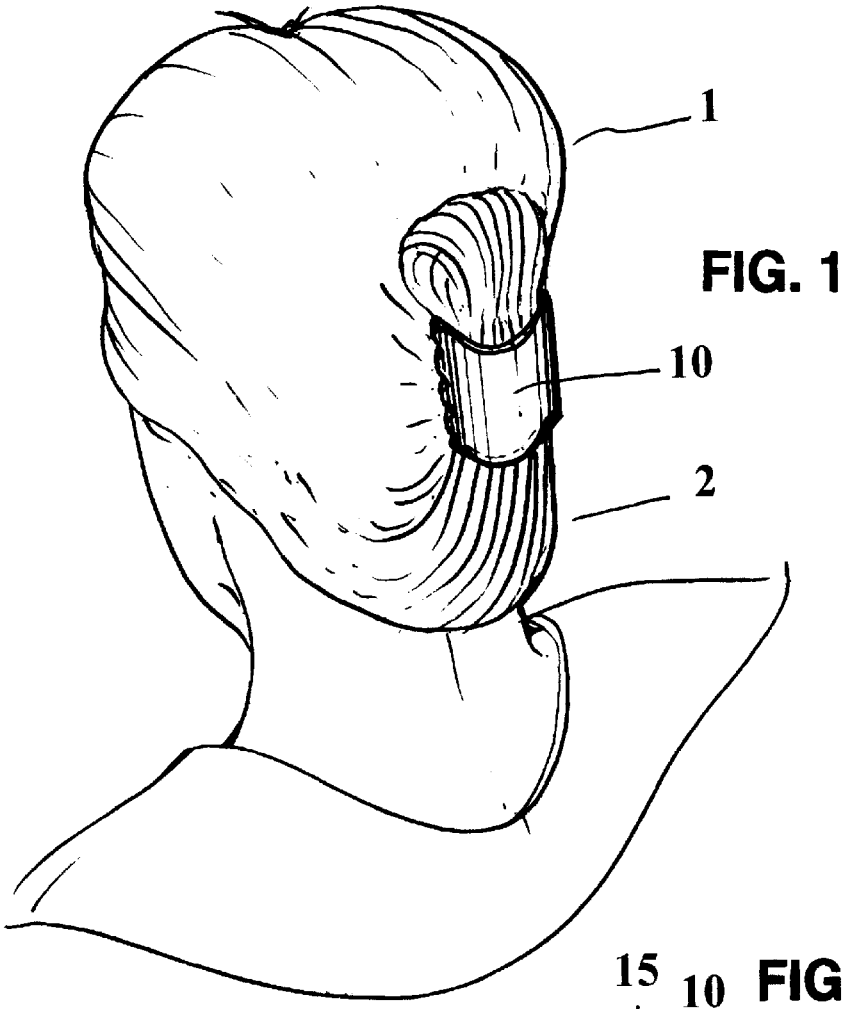
FIG. 1 is a perspective view of a generally circular barrette operably engaged to a woman's hair.

Referring to the drawings by characters of reference, FIG. 1 discloses a perspective view of a generally circular barrette 10 on the head of a woman 1. Generally circular barrette 10 encircles and holds a length of a woman's hair 2 in a fixed position.

The generally circular barrette 10 is made of a single strip of PETG plastic. PETG is a desirable material because it is flexible at room temperatures, waterproof, and unaffected by most chemicals. In addition, PETG can be produced in a variety of colors. PETG barrettes can be made through an injection molding manufacturing process. Through being comprised of a single piece that can be made through an injection molding process, this barrette has a manufacturing cost lower than barrettes that have multiple components which require assembly.

Figure 2:
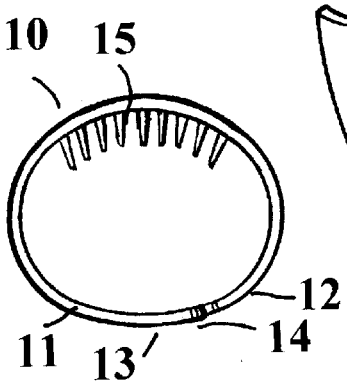
FIG. 2 is a top view of a generally circular barrette illustrating the hair gripping teeth.

FIG. 2 discloses a top view of the generally circular barrette 10. This figure illustrates the hair teeth 15 on the interior of the generally circular barrette 10. These teeth are molded in the generally circular barrette 10. The hair teeth 15 grip the woman's hair 2 and prevent it from slipping through the generally circular barrette 10. The generally circular barrette 10 is shown in the closed position in this figure. The left matting end 11 with left mating teeth 13 are mated with the right mating end 12 with right mating teeth 14.

Figure 3:
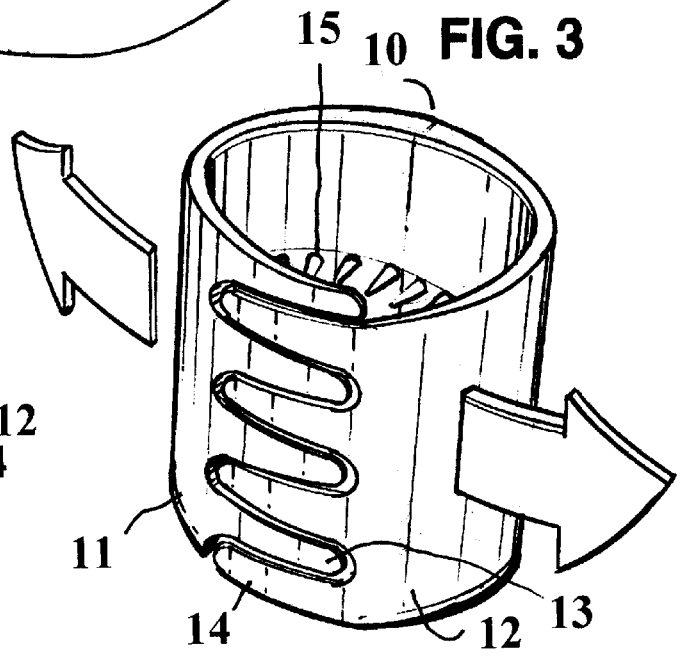
FIG. 3 is a perspective view of the generally circular barrette illustrating the two ends having mated teeth and how these ends may be pulled apart.

FIG. 3 illustrates a perspective view of the generally circular barrette 10 in a closed position. The barrette 10 is generally formed in the shape of a right annular cylinder. This figure shows how the left mating end 11 can be separated from the right mating end 12 to put the generally circular barrette 10 in an open position to receive hair 2. The left mating teeth 13 and right mating teeth 14 are shown in a mated position. The left mating teeth 13 and right mating teeth 14 are comprised of "V" shaped teeth each having a radiused tip 28 and a radiused root 29. The hair teeth 15 are visible in the interior of the generally circular barrette 10.

The material used for the generally circular barrette 10 is crucial. The critical design parameter is that a user will only cause elastic deformation in the generally circular barrette 10 when pulling the left and right mating ends 11 and 12 apart to insert hair 2. By only causing elastic deformation in the generally circular barrette 10, the generally circular barrette 10 will return to its original shape when the user releases the mating ends 11 and 12. In addition, a user must be able to deform the generally circular barrette 10 with a minimal amount of force applied by her hands. PETG is one preferred material that has these desired tensile properties and is used for the present invention.

A front view of the generally circular barrette 10 is shown in FIG. 4. The generally circular barrette 10 is shown in the closed position in this figure. The left mating end 11 with left mating teeth 13 is mated with the right mating end 12 with right mating teeth 14.

The process of placing the generally circular barrette 10 onto the hair 2 of a woman's head 1 is illustrated in FIGS. 5 and 6. Referring to FIG. 5, the left mating end 11 is separated from the right mating end 12 placing the generally circular barrette 10 in tension. This places the generally circular barrette 10 in an open position. The hair teeth 15 mechanically grip the hair 2. Then as illustrated in FIG. 6, releasing mating ends 11 and 12 from tension enable mating ends 11 and 12 to close around and secure hair 2 in a styled position. The hair teeth 15 grip the hair 2 preventing it from sliding out of the generally circular barrette 10.

A cross sectional view of the generally circular hair barrette is disclosed in FIG. 7. The plane on which this cross section is taken is shown in FIG. 4. This figure illustrates that the hair teeth 15 are molded into the generally circular barrette 10.

The generally circular barrette 10 is shown in the open position in FIG. 8. The left mating end 11 having left mating teeth 13 is separated from the right mating end 12 having right mating teeth 14. The hair teeth 15 are shown on the interior of the generally circular barrette 10. In this open position, the generally circular barrette is elastically deformed. The generally circular barrette 10 will return to the closed position illustrated in FIG. 4 once the forces holding the mating ends 11 and 12 apart are released.

An alternative embodiment for the generally circular barrette 10 is shown in FIG. 9. This figure illustrates a top view of a handled barrette 20. The handled barrette 20 is made of a single strip of PETG plastic as is the generally circular barrette 10. The handled barrette 20 has a left mating end 21 and a right mating end 22. The left and right mating ends 21 and 22 respectively have left and right mating teeth 23 and 24 that are mated in the closed position. In addition, the handled barrette 20 has a handle 25 with a left handle grip 26 and right handle grip 27. The handled barrette 20 is shown in the closed position.

FIG. 10 illustrates the handled barrette 20 in the open position. The left mating end 21 having left mating teeth 23 is separated from the right mating end 22 having right mating teeth 24. It is in this open position when the handled barrette 20 can receive hair 2. In the open position, the left and right handle portions 26 and 27 are shown deformed from their position in FIG. 9.

FIG. 11 illustrates the direction of the forces that a user would place on the handle 25 in order to open the handled barrette 20 to receive hair 2. Through pulling the left and right handle portions 26 and 27, while pushing the handle center 28, the user can cause the handled barrette to open into the position shown in FIG. 10. As with the generally circular barrette 10, the handled barrette 20 is only placed in elastic deformation when in an open position. Therefore, when the forces placed on the handle 25 that hold the handled barrette 20 in an open position are released, the device returns to a closed position as illustrated by FIG. 9.

A perspective view of the handled barrette 20 in an open position is shown in FIG. 12. The left and right grips 26 and 27 of handle 25 are deformed by the forces illustrated by FIG. 11. The left and right mating ends 21 and 22 are separated revealing the left and right mating teeth 23 and 24.

A perspective view of the handled barrette 20 operably engaged to hair 2 on a woman's head 1 is illustrated in FIG. 13.

While these descriptions directly describe the above embodiments, it is understood that those skilled in the art may conceive modifications and/or variations to the specific embodiments shown and described herein. Any such modifications or variations that fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A single-piece hair clasp comprising:

an elastically deformable strip having a first end and a second end, said strip formed into a generally right annular cylinder, said first end is provided with a first row of substantially V-shaped teeth, said second end is provided with a second row of substantially V-shaped teeth, each row of substantially V-shaped teeth includes a tip and a root, said tip and said root each having a radius, the tip of each substantially V-shaped tooth and at the root between adjacent substantially V-shaped teeth have the same radius, whereby said first row of substantially V-shaped teeth and said second row of substantially V-shaped teeth are interleaved consistent with the general shape of the right annular cylinder and the radiused tips of each row of substantially V-shaped teeth nests in the radiused roots of the opposing row of substantially V-shaped teeth.

2. A single-piece hair clasp, as recited in claim 1, further comprising a plurality of substantially V-shaped teeth extending radially inwards from an interior surface of said elastically deformable strip and being of a sufficient length to engage a user's hair.

3. A single-piece hair clamp, as recited in claim 2, further comprising an elastically deformable strip wherein said substantially V-shaped teeth are made of PETG.

4. A single-piece hair clasp comprising:

an elastically deformable strip having a first end and a second end, said first end is provided with a first row of substantially V-shaped teeth, said second end is provided with a second row of substantially V-shaped teeth, each row of substantially V-shaped teeth includes a tip and a root, said tip and said root each having a radius, the tip of each substantially V-shaped tooth and at the root between adjacent substantially V-shaped teeth, whereby said elastically deformable strip is shaped such that said first row of substantially V-shaped teeth and said second row of substantially V-shaped teeth are interleaved consistent with the general shape of a right annular cylinder and the tips of each row of substantially V-shaped teeth nests in the roots of the opposing row of V-shaped teeth.

5. A single-piece hair clasp, as recited in claim 4 further including a handle, said handle is formed from said elastically deformable strip, said handle has a left portion and a right portion, whereby pressing said left portion in closer proximity to said right portion separates said first end from said second end and thereby capable of receiving a lock of hair therebetween.

6. A single-piece hair clasp, as recited in claim 5, further comprising teeth extending radially inwards from an interior surface of said elastically deformable strip and being of a sufficient length to engage a user's hair.

7. A single-piece hair clamp, as recited in claim 6, further comprising an elastically deformable strip and teeth made of PETG.

* * * * *